US009903576B2

(12) United States Patent
Creasman et al.

(10) Patent No.: US 9,903,576 B2
(45) Date of Patent: Feb. 27, 2018

(54) LIGHTING APPARATUS WITH ELECTRICAL CONNECTOR AND CONTROL MODULE

(71) Applicant: Cree, Inc., Durham, NC (US)

(72) Inventors: Ethan Creasman, Raleigh, NC (US); Nathan Ray Snell, Raleigh, NC (US)

(73) Assignee: Cree, Inc., Durham, NC (US)

( * ) Notice: Subject to any disclaimer, the term of this patent is extended or adjusted under 35 U.S.C. 154(b) by 200 days.

(21) Appl. No.: 14/739,185

(22) Filed: Jun. 15, 2015

(65) Prior Publication Data

US 2016/0363303 A1 Dec. 15, 2016

(51) Int. Cl.

| | |
|---|---|
| ***F21V 23/04*** | (2006.01) |
| ***F21V 29/77*** | (2015.01) |
| ***F21K 9/20*** | (2016.01) |
| *F21V 23/06* | (2006.01) |
| *F21W 131/10* | (2006.01) |
| *F21W 131/103* | (2006.01) |
| *F21Y 115/10* | (2016.01) |
| *F21Y 107/00* | (2016.01) |

(52) U.S. Cl.

CPC ..... *F21V 23/0464* (2013.01); *F21K 9/20* (2016.08); *F21V 23/0471* (2013.01); *F21V 29/77* (2015.01); *F21V 23/0435* (2013.01); *F21V 23/06* (2013.01); *F21W 2131/10* (2013.01); *F21W 2131/103* (2013.01); *F21Y 2107/00* (2016.08); *F21Y 2115/10* (2016.08)

(58) Field of Classification Search

CPC ..... F21V 23/0464; F21V 23/0471; F21V 23/045; F21V 23/0457; F21V 23/0478; F21V 23/0485; F21V 23/0492; F21S 8/088; F21S 8/086; F21S 2/005; H05B 33/0869; H05B 33/0872

See application file for complete search history.

(56) References Cited

U.S. PATENT DOCUMENTS

| | | | | |
|---|---|---|---|---|
| 1,912,601 A * | 6/1933 | Steinmayer Alwin G | F21V 17/12 362/296.04 |
| 5,442,532 A * | 8/1995 | Boulos | F21S 8/033 340/567 |
| 5,626,417 A * | 5/1997 | McCavit | F21S 8/033 250/353 |

(Continued)

OTHER PUBLICATIONS

U.S. Appl. No. 61/932,058, filed Jan. 27, 2014.

*Primary Examiner* — Robert May

(74) *Attorney, Agent, or Firm* — Dennis J. Williamson; Moore & Van Allen PLLC

(57) ABSTRACT

A lighting apparatus has an at least partially optically transmissive enclosure and a light source located in the enclosure that is operable to emit light when energized through an electrical path. A connector is secured to the base and is configured to receive a control module for providing control information to the LED light source. The control module is rotatably mounted relative to the enclosure. The control module may comprise a sensor that turns the light source off and on, changes the color of the light source or dims the light source upon detection of the stimulus. The enclosure has a bottom member and a mounting portion secured to the bottom support where the connector is located between the mounting portion and the bottom support.

18 Claims, 8 Drawing Sheets

(56) References Cited

U.S. PATENT DOCUMENTS

| | | | | |
|---|---|---|---|---|
| 5,814,945 | A * | 9/1998 | Hsu | H05B 37/0227 315/156 |
| 7,213,940 | B1 | 5/2007 | Van De Ven et al. | |
| 8,292,452 | B2 * | 10/2012 | Ko | F21S 8/081 362/183 |
| 8,550,655 | B1 * | 10/2013 | Wang | F21K 9/23 362/216 |
| 2006/0044789 | A1 * | 3/2006 | Curtis | F21S 8/088 362/152 |
| 2007/0177384 | A1 * | 8/2007 | Sibalich | F21S 8/088 362/276 |
| 2011/0273102 | A1 | 11/2011 | van de Ven et al. | |
| 2012/0206050 | A1 * | 8/2012 | Spero | B60Q 1/04 315/152 |
| 2013/0026923 | A1 | 1/2013 | Athalye et al. | |
| 2013/0026925 | A1 | 1/2013 | Ven et al. | |
| 2013/0069535 | A1 | 3/2013 | Athalye | |
| 2013/0069547 | A1 | 3/2013 | van de Ven et al. | |
| 2013/0119872 | A1 | 5/2013 | Chobot | |
| 2013/0162149 | A1 | 6/2013 | van de Ven et al. | |
| 2013/0162153 | A1 | 6/2013 | van de Ven et al. | |
| 2013/0169159 | A1 | 7/2013 | Lys | |
| 2013/0293135 | A1 | 11/2013 | Hu et al. | |
| 2014/0001959 | A1 | 1/2014 | Motley et al. | |
| 2014/0001963 | A1 | 1/2014 | Chobot et al. | |
| 2014/0167620 | A1 | 6/2014 | Chobot | |
| 2014/0167622 | A1 | 6/2014 | Chobot et al. | |
| 2014/0167623 | A1 | 6/2014 | Chobot et al. | |
| 2014/0167642 | A1 | 6/2014 | Chobot | |
| 2014/0167653 | A1 | 6/2014 | Chobot | |
| 2014/0268790 | A1 | 9/2014 | Chobot et al. | |
| 2015/0102729 | A1 | 4/2015 | Creasman et al. | |

* cited by examiner

LIGHTING APPARATUS WITH ELECTRICAL CONNECTOR AND CONTROL MODULE

BACKGROUND

In some lighting apparatuses a sensor is mounted to the top of the lighting apparatus for controlling the operation of the light source associated with the lighting apparatus. Such lighting apparatuses may be used in outdoor applications such as in parking lots, adjacent pathways or roadways, adjacent or on buildings or the like. Typically, the sensor functions as an on/off switch to turn the light source on based on the detection of ambient darkness and to turn the light source off based on the detection of ambient light. A sensor mounted to the top of the lighting apparatus may be unsightly, especially on lighting apparatuses that are intended to be decorative or aesthetically highlight architectural aspects of a space. Such sensors may be an "afterthought" to the aesthetics of the lighting apparatus that are visually intrusive.

SUMMARY

In some embodiments, a lighting apparatus comprises an at least partially optically transmissive enclosure comprising a base positioned at the bottom of the enclosure. A LED light source is located in the enclosure and is operable to emit light when energized through an electrical path. A connector is secured to the base and is configured to receive a control module for controlling the LED light source.

The control module may comprise a sensor where the sensor controls the light source upon detection of a stimulus. The base may comprise an aperture providing communication between the sensor and the stimulus. The base may comprise a bottom member forming part of the enclosure and a mounting member secured to the bottom member, the connector may be located between the mounting member and the bottom member. The base may comprise a transparent window between the mounting member and the bottom member. The transparent window may comprise the support structure for the enclosure on the mounting member. The connector may be rotatably mounted on the base. The enclosure may be rotatable relative to the mounting member. The sensor may detect the presence or absence of ambient light or the presence or absence of an object. A drip guard may surround the connector and may comprise an annular flange. The control module may be rotatably coupled to the enclosure by the connector. The sensor may turn the light source off upon detection of the stimulus. The sensor may change the color of the emitted light upon detection of the stimulus. The control module may comprise a communication module for receiving external control signals. The control module may provide control information to the light source. The communication module may comprise a wireless receiver for receiving external wireless signals.

In some embodiments a lighting apparatus comprises an at least partially optically transmissive enclosure. A LED light source is located in the enclosure and operable to emit light when energized through an electrical path. A connector is secured to the bottom of the enclosure and is configured to receive a control module for providing control information to the LED light source.

The control module may comprise a sensor for detecting external stimuli. The sensor may turn the light source off and on upon detection of the stimuli. The enclosure may comprise a bottom member where the connector is located between a mounting member and the bottom member.

DETAILED DESCRIPTION

Figure 1:
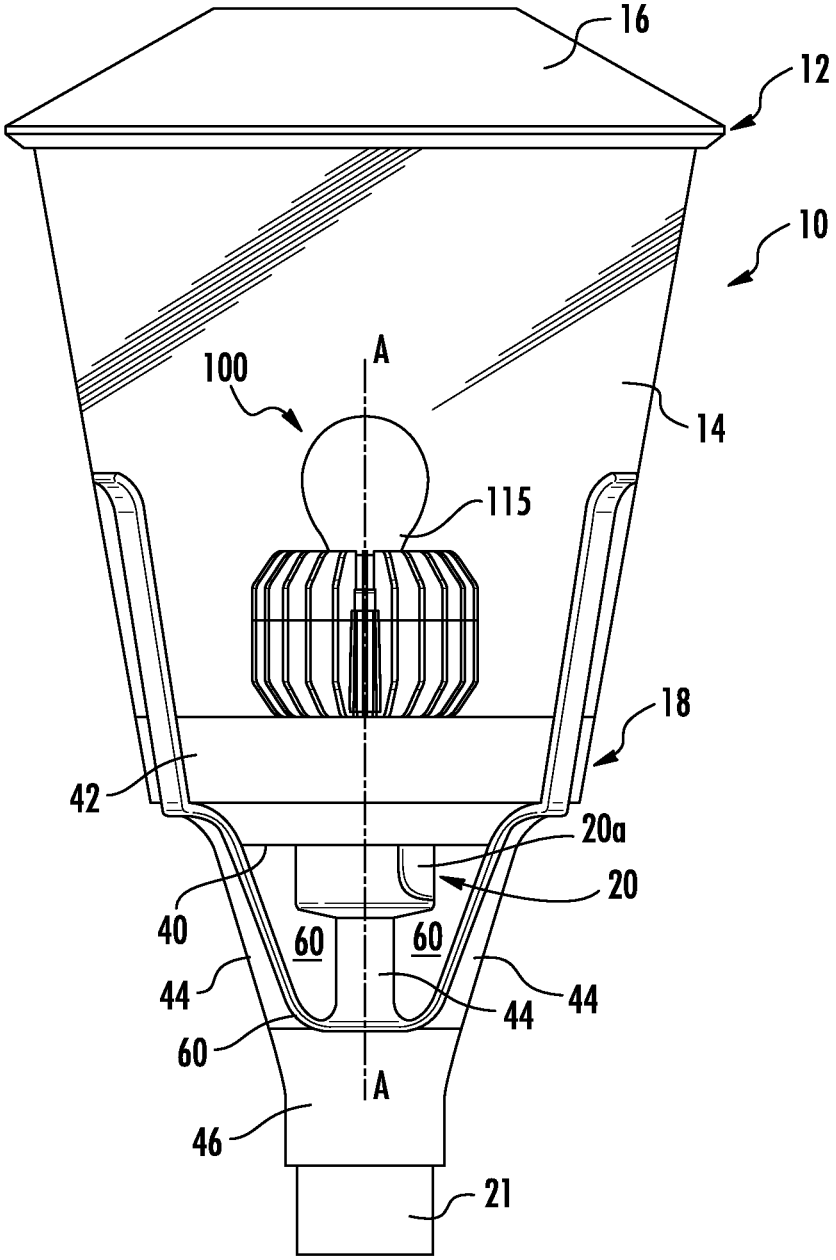
FIG. 1 is a front view of an embodiment of a lighting apparatus of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Figure 2:
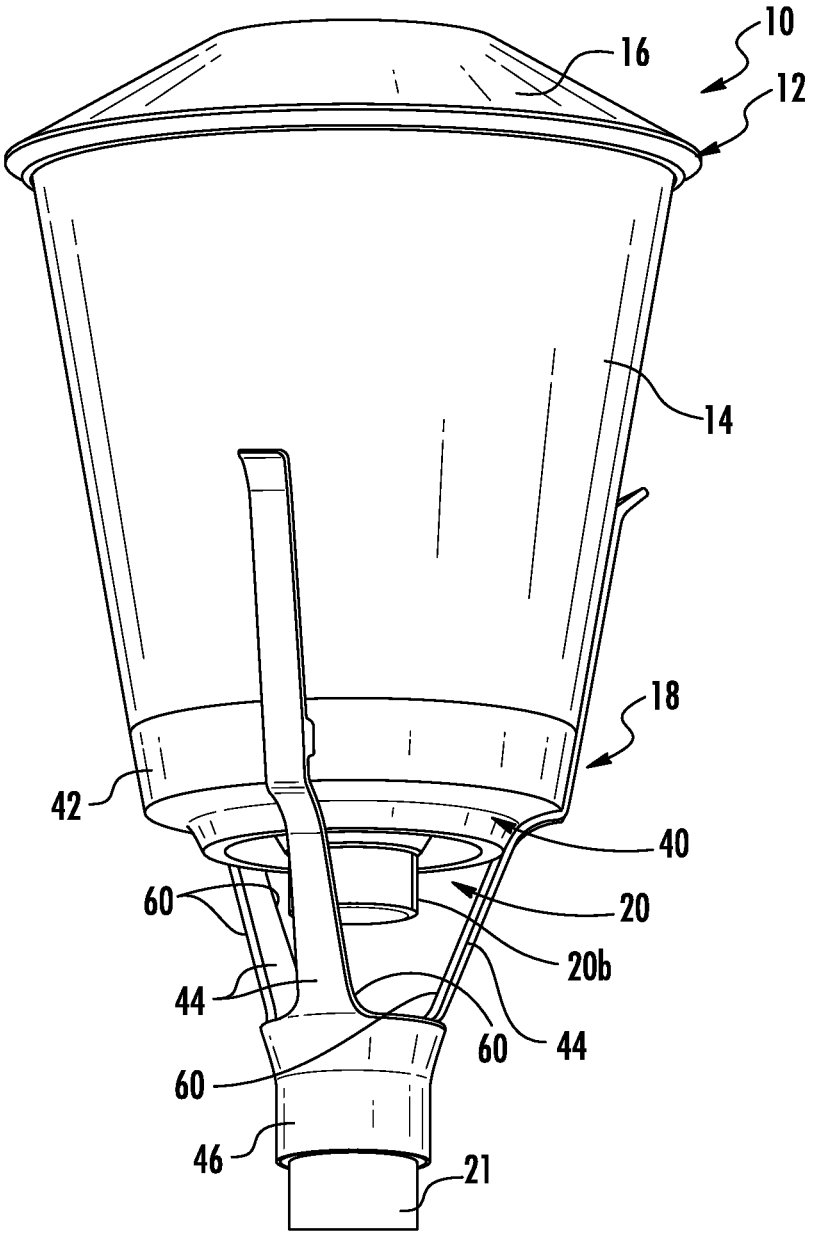
FIGS. 2 and 3 are perspective views of another embodiment of the lighting apparatus of the invention.
Figure 3:
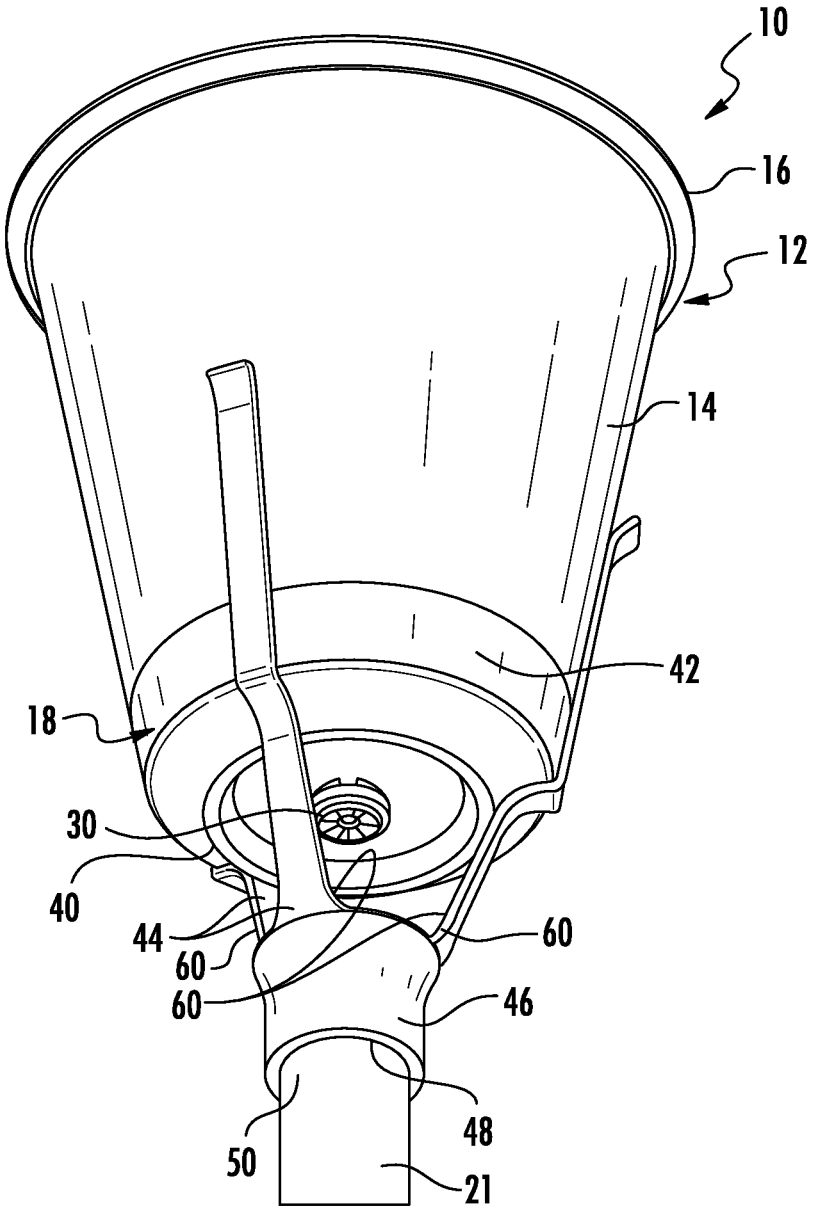

Lighting apparatuses as described herein may be used in a wide variety of applications such as decorative outdoor lighting. One embodiment of a decorative outdoor lighting apparatus 10 is shown in FIGS. 1-3. Lighting apparatus 10 comprises an at least partially transmissive enclosure 12 that houses a light source such as a LED lamp 100. Enclosure 12 comprises an optically transmissive lens 14. While lamp 100 is visible in FIG. 1 through clear lens 14, in some lighting apparatuses the lens 14 may be textured, frosted, coated or otherwise be diffusive such that the lamp 100 is not readily visible as shown, for example, in FIGS. 2 and 3. The lens 14 may be made of glass, quartz, borosilicate, silicate, polycarbonate, other plastic or other suitable material such that light emitted from lamp 100 may be transmitted to the outside of lighting apparatus 10 through the optically transmissive lens 14. In some embodiments, the lens 14 may be coated on the inside with silica, providing a diffuse scattering layer that produces a more uniform far field pattern. The lens 14 may also be etched, frosted or otherwise coated to provide the diffuser. In other embodiments the lens 14 may be made of a material such as plastic, such as polycarbonate, where the diffuser is created by the plastic material itself or by additives to the plastic material. Alternatively, the surface treatment may be omitted and a clear lens may be provided. The lens may also be provided with a shatter proof or shatter resistant coating. The enclosure 12 may be enclosed by a cap 16 and a base 18 that may be connected to the lens 12 and/or to one another to form the at least partially transmissive enclosure 12. The cap 16 may be secured to the top of the lens 14 and the base 18 may be secured to the bottom of the lens 14 such that in use the base 18 is disposed vertically below the cap 16 and lens 14. The cap 16 and base 18 may be opaque and may be formed of any suitable material such as metal, plastic or the like or combinations of materials. In other embodiments the enclosure 12 may have a wide variety of shapes and sizes and more or less of the enclosure 12 may be optically transmissive. For example the opaque cap 16 may be eliminated and the lens 14 may be formed as a globe with the base 18 attached to the bottom of the globe. Typically, one or both of the cap 16 and base 18 are removable to allow access to the interior of the lighting apparatus 10 for replacement of the light source 100, repair, installation and the like. The lighting apparatus 10 may be mounted on a lamp pole 21 or other suitable support structure, such as a building or the like, for providing illumination on paths, roads, driveways, entrances and the like.

In one embodiment the light source 100 comprises a LED lamp. In one typical embodiment an omnidirectional lamp 100 is supported in the lighting apparatus 10 and is electrically coupled to a power source 101. The lamp may be connected to the electrical power source using a screw thread base such as an Edison base or a mogul base that connects to a corresponding socket or the lamp may be wired directly to the electrical supply lines from the power source 101 for the lighting apparatus 10.

Figure 5:
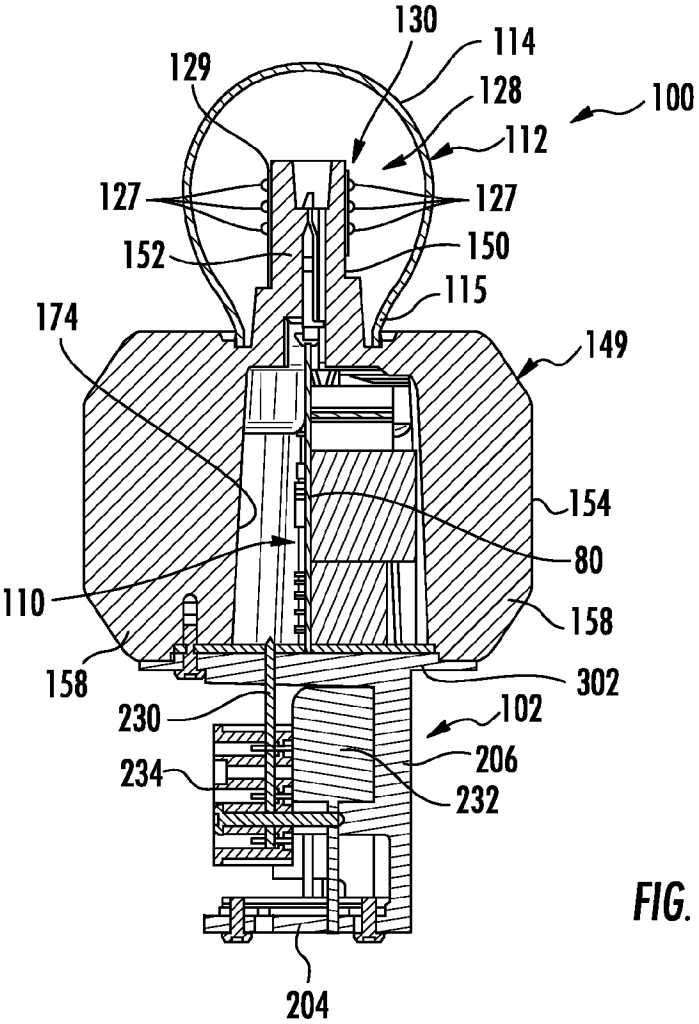
FIG. 5 is a section view of the light source of FIG. 4.
Figure 4:
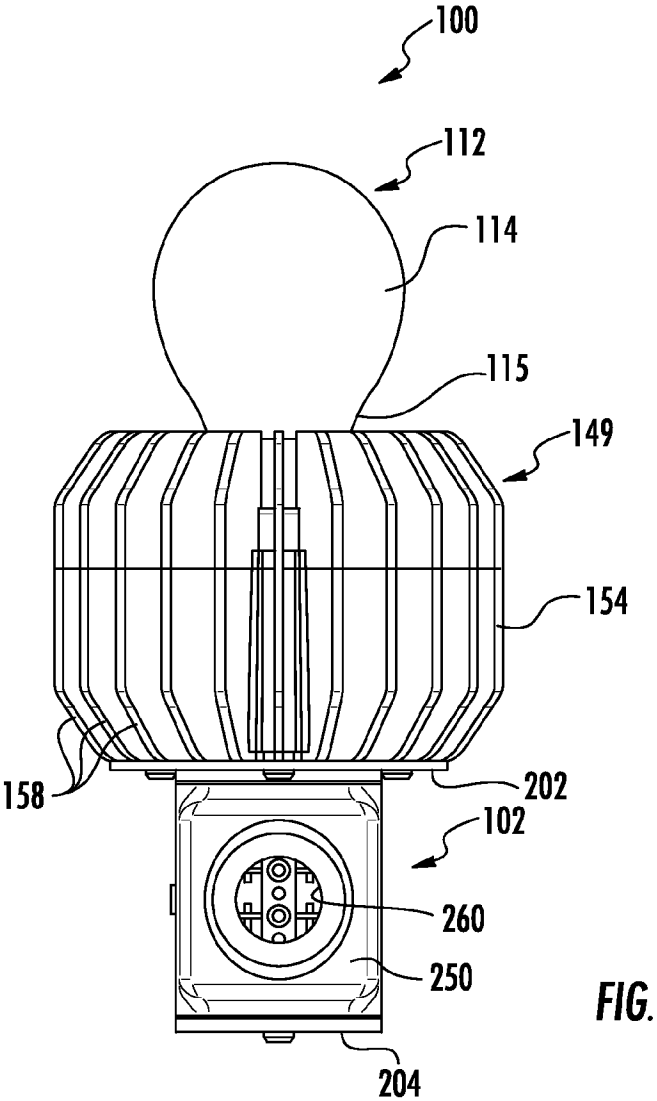
FIG. 4 is a side view of an embodiment of a LED light source usable in the lighting apparatus of the invention.

Referring to FIGS. 4 and 5 an example embodiment of a solid-state lamp 100 is shown and described herein comprising a LED assembly 130 with light emitting LEDs 127. Multiple LEDs 127 can be used together, forming an LED array 128. The LEDs 127 in the LED array 128 may comprise an LED die disposed in an encapsulant such as silicone, and/or LEDs which are encapsulated with a phosphor to provide local wavelength conversion. A wide variety of LEDs and combinations of LEDs may be used in the LED assembly 130. The LEDs 127 of the LED array 128 are operable to emit light when energized through an electrical path. The term "electrical path" is used to refer to the electrical path to the LED's 127, and may include an intervening power supply, drivers and/or other lamp electronics, and includes the electrical connection between the electrical connector that provides power to the lamp and the LED array. The term may also be used to refer to the electrical connection between the power supply and the LEDs and between the electrical connector to the lamp and the power supply. Electrical conductors run between the LEDs 127 and the lamp base 102 to carry both sides of the supply to provide critical current to the LEDs 127 as will be described. The LEDs 127 may be mounted on a submount 129 that may form a part of the electrical path to the LEDs. In the present invention the term "submount" is used to refer to the support structure that supports the individual LEDs or LED packages and in may comprise a printed circuit board, metal core printed circuit board, lead frame extrusion, FR4 board, flex circuit or the like or combinations of such structures. The electrical path runs between the submount 129 and the electrical connector in the lamp base 102 to carry both sides of the supply to provide critical current to the LEDs 127.

In some embodiments, the submount 129 may be made of or comprise a thermally conductive material. The submount 129 may comprise a LED mounting portion that functions to mechanically support and electrically couple the LEDs 127 to the electrical path and a second connector portion that functions to provide thermal, electrical and/or mechanical connections to the LED assembly 130. The submount 129 may comprise a series of anodes and cathodes arranged in pairs for connection to the LEDs 127. The number of anode/cathode pairs and LEDs may vary and more than one submount may be used to make a single LED assembly 130. Electrical connectors or conductors such as traces connect the anode from one pair to the cathode of the adjacent pair to provide the electrical path between the anode/cathode pairs during operation of the LED assembly 130. An LED or LED package containing at least one LED 127 is secured to each anode and cathode pair where the LED/LED package spans the anode and cathode. The LEDs/LED packages may be attached to the submount by soldering.

The LED assembly 130 may be contained in an optically transmissive enclosure 112 through which light emitted by the LEDs 127 is transmitted to the exterior of the lamp. The enclosure 112 may be entirely optically transmissive where the entire enclosure 112 defines the exit surface through which light is emitted from the lamp. The enclosure 112 may have a traditional bulb shape having a globe shaped main portion 114 that narrows to a neck 115. The enclosure 112 may be made of glass, quartz, borosilicate, silicate, polycarbonate, other plastic or other suitable material. In some embodiments, the exit surface of the enclosure may be coated on the inside with silica, etched, frosted or otherwise coated to provide a diffusive layer. In other embodiments the enclosure may be made of a material such as polycarbonate where the diffuser is created by the polycarbonate material. Alternatively, the surface treatment may be omitted and a clear enclosure may be provided. The enclosure may also be provided with a shatter proof or shatter resistant coating. It should also be noted that in this or any of the embodiments shown here, the optically transmissive enclosure or a portion of the optically transmissive enclosure could be coated or impregnated with phosphor.

LEDs and/or LED packages used with an embodiment of the invention can include light emitting diode chips that emit hues of light that, when mixed, are perceived in combination as white light. Phosphors can be used as described to add yet other colors of light by wavelength conversion. For example, blue or violet LEDs can be used in the LED assembly of the lamp and the appropriate phosphor can be in any of the ways mentioned above. LED devices can be used with phosphorized coatings packaged locally with the LEDs or with a phosphor coating the LED die as previously described. For example, blue-shifted yellow (BSY) LED devices, which typically include a local phosphor, can be used with a red phosphor on or in the optically transmissive enclosure or inner envelope to create substantially white light, or combined with red emitting LED devices in the array to create substantially white light.

A lighting system using the combination of BSY and red LED devices referred to above to make substantially white light can be referred to as a BSY plus red or "BSY+R" system. In such a system, the LED devices used include LEDs operable to emit light of two different colors. A further detailed example of using groups of LEDs emitting light of different wavelengths to produce substantially while light can be found in issued U.S. Pat. No. 7,213,940, which is incorporated herein by reference in its entirety.

The LED assembly 130 may be mounted to a heat sink structure 149 and an electrical interconnect 150 may provide the electrical connection between the LED assembly 130 and the lamp electronics 110. The heat sink structure 149 comprises a heat conducting portion or tower 152 and a heat dissipating portion 154. In one embodiment the heat sink 149 is made as a one-piece member of a thermally conductive material such as aluminum, zinc or the like. The heat sink structure 149 may also be made of multiple components secured together to form the heat structure. Moreover, the heat sink 149 may be made of any thermally conductive material or combinations of thermally conductive materials.

The heat conducting portion 152 may be formed as a tower that is dimensioned and configured to make good thermal contact with the LED assembly 130 such that heat generated by the LED assembly 130 may be efficiently transferred to the heat sink 149. In one embodiment, the heat conducting portion 152 extends along the longitudinal axis of the lamp and extends into the center of the enclosure 112. The heat dissipating portion 154 is in good thermal contact with the heat conducting portion 152 such that heat conducted away from the LED assembly 130 by the heat conducting portion 152 may be efficiently dissipated from the lamp 100 by the heat dissipating portion 154. The heat dissipating portion 154 extends from the interior of the enclosure 112 to the exterior of the lamp 100 such that heat may be dissipated from the lamp to the ambient environment. A plurality of heat dissipating members such as planar fins 158 may be formed on the exposed portion to facilitate the heat transfer to the ambient environment.

The electrical interconnect 150 comprises electrical conductors that form part of the electrical path connecting the LED assembly 130 to the lamp electronics 110 supported on lamp electronics board 80. The interconnect 150 may provide an electrical connection between the LED assembly 130 and the lamp electronics 110 that does not require bonding of the contacts from the lamp electronics 110 to the LED assembly 130. The electrical interconnect 150 comprises a first conductor for connecting to one of the anode or cathode side of the LED assembly 130 and a second conductor for connecting to the other one of the anode or cathode side of the LED assembly 130. When the electrical interconnect 150 is mounted to the heat sink 149 and the LED assembly 130 is mounted on the heat sink 149, an electrical path is created between the conductors of the electrical interconnect 150 and the LED assembly 130 and between the conductors of the electrical interconnect 150 and the lamp electronics board 80. These components are physically and electrically connected to one another and the electrical path between the lamp electronics 110 and the LEDs 127 is created.

In some embodiments, a driver and/or power supply may be included with the LED array 128 on the submount 129. In other embodiments the lamp electronics 110 such as the driver and/or power supply are mounted on electronics board 80 and may be located at least partially in an internal cavity 174 the heat sink 149 as shown for example in FIG. 5 where the size and shape of the heat sink may be configured to house the lamp electronics 110. The power supply and drivers may also be mounted separately where components of the power supply are mounted in the heat sink 149 and the driver is mounted with the submount 129 in the enclosure 112. The heat sink 149 may include a power supply or driver and form all or a portion of the electrical path between the mains and the LEDs 127. The heat sink 149 may also include only part of the power supply circuitry while some smaller components reside on the submount 129. Suitable power supplies and drivers are described in U.S. patent application Ser. No. 13/462,388 filed on May 2, 2012 and titled "Driver Circuits for Dimmable Solid State Lighting Apparatus" which is incorporated herein by reference in its entirety; U.S. patent application Ser. No. 12/775,842 filed on May 7, 2010 and titled "AC Driven Solid State Lighting Apparatus with LED String Including Switched Segments" which is incorporated herein by reference in its entirety; U.S. patent application Ser. No. 13/192,755 filed Jul. 28, 2011 titled "Solid State Lighting Apparatus and Methods of Using Integrated Driver Circuitry" which is incorporated herein by reference in its entirety; U.S. patent application Ser. No. 13/339,974 filed Dec. 29, 2011 titled "Solid-State Lighting Apparatus and Methods Using Parallel-Connected Segment Bypass Circuits" which is incorporated herein by reference in its entirety; U.S. patent application Ser. No. 13/235,103 filed Sep. 16, 2011 titled "Solid-State Lighting Apparatus and Methods Using Energy Storage" which is incorporated herein by reference in its entirety; U.S. patent application Ser. No. 13/360,145 filed Jan. 27, 2012 titled "Solid State Lighting Apparatus and Methods of Forming" which is incorporated herein by reference in its entirety; U.S. patent application Ser. No. 13/338,095 filed Dec. 27, 2011 titled "Solid-State Lighting Apparatus Including an Energy Storage Module for Applying Power to a Light Source Element During Low Power Intervals and Methods of Operating the Same" which is incorporated herein by reference in its entirety; U.S. patent application Ser. No. 13/338,076 filed Dec. 27, 2011 titled "Solid-State Lighting Apparatus Including Current Diversion Controlled by Lighting Device Bias States and Current Limiting Using a Passive Electrical Component" which is incorporated herein by reference in its entirety; and U.S. patent application Ser. No. 13/405,891 filed Feb. 27, 2012 titled "Solid-State Lighting Apparatus and Methods Using Energy Storage" which is incorporated herein by reference in its entirety.

The AC to DC conversion may be provided by a boost topology to minimize losses and therefore maximize conversion efficiency. The boost supply is connected to high voltage LEDs operating at greater than 200V. Other embodiments are possible using different driver configurations, or a boost supply at lower voltages.

LED lighting systems according to embodiments of the present invention can work with a variety of different types of power supplies or drivers. For example, a transformer with a bridge rectifier, a buck converter, boost converter, buck-boost converter, or single ended primary inductor converter (SEPIC) circuit could all be used as a driver for an LED lighting system or solid-state lamp like that described herein. A SEPIC provides for universal input, wide output voltage range (30 to 150 V in some cases), good efficiency, non-isolation, and can be designed as a single stage for low-cost.

The base 102 may be connected to the heat sink 149 using a mounting plate 202 that is connected to the heat sink using fasteners such as screws or other connection mechanism. The lamp may be integrated into a lighting apparatus or it may be configured to fit into an existing lighting apparatus. The base 102 of the lamp is physically mounted in the lighting apparatus and, in some embodiments, the base 102 includes a universal mounting plate 204 that allows it to be mounted to the existing mounting structure of the light. The electrical supply wires from the power supply 101 are connected to the base 102 of the lamp of the invention to deliver current to the LEDs 127 in the lamp 100.

Wires or other connectors 230 extend from the lamp electronics 110 into the base 102 for delivering current to the LED assembly 130. The wires 230 may be soldered to electronics board 80 and may extend from the interior of the heat sink 149 into the interior of the base 102. In one embodiment, the electrical path to the lamp electronics 110 includes a surge protector 232 for protecting the lamp electronics 110 in the event of a power surge such as a lightning strike. An electrical connector 234, such as a terminal block, may be used to facilitate connection of the wires from the power supply 101 to the lamp 100 and to facilitate removal of the surge protector in the event of a power surge. A door 250 may be secured to the wall 206 of the base 102 to isolate the lamp electronics from the external environment. A knockout aperture 260 may be provided to allow the electrical supply wires from the power supply 101 to enter the base 102 and connect to the terminal block 234. While in some embodiments the lamp may comprise a base 102 as shown that is hard wired to the electrical supply of the lamp, in other embodiments the lamp base 102 may be provided with a mating screw connector such as an Edison screw or mogul screw such that the lamp may be screwed into an existing mating receptacle.

Referring to FIGS. 1 through 3, in many embodiments it is advantageous to provide a control module 20 for automatically controlling the light source 100 upon detection of an external stimulus or reception of an external control signal. The light source may be controlled for security, convenience or the like based on the presence of an external stimulus such as the presence or absence of ambient light, the presence of an object such as a vehicle, person, or the like, or the light source may be controlled based upon receipt of a signal from a remote controller. Numerous different types of control modules 20 may be used to detect the external stimulus and to control operation of the light source 100. The control module 20 may comprise a sensor **20*a* such as a light detector for detecting the presence or absence of ambient light. The sensor 20*a* may turn on the light source 100 when the ambient light is dark and turn off the light source 100 when the ambient light is bright. Such a sensor may be commonly referred to as a dusk to dawn or daylight sensor and may comprise photoresistors, photodiodes, phototransistors or the like. The control module 20 may also comprise a sensor 20***b* such as an occupancy or motion detector such as active type or passive type motion detector. For example, the active type motion detectors such as radar-based motion detectors emit optical, microwave, RF or acoustic waves that are reflected back to and detected by the sensor. Passive infrared motion detectors detect emitted infrared energy given off by objects in the form of heat. When the sensor 20*b* detects a stimulus the control module 20 may activate or deactivate the light source 100. Other types of sensors and detectors may also be used. The sensor may also comprise combinations of detectors. In some embodiments NEMA (National Electrical Manufacturers Association) compliant sensors may be used.

In a typical application a daylight sensor is mounted to the top of the lighting apparatus. In such applications the sensor may be unsightly, especially on lighting apparatuses that are intended to be decorative or aesthetically highlight architectural aspects of a space. Such sensors may be an "afterthought" to the aesthetics of the lighting apparatus that are visually intrusive. In the lighting apparatus of the invention the control module 20 is mounted to the bottom of the enclosure 12 such that the control module 20 is relatively hidden from view, is unobtrusive and does not affect the overall appearance of the lighting apparatus. In one embodiment the control module 20 may be connected to a connector 30, such as a NEMA mount, multi-pin connector or the like, located on the bottom of the lighting apparatus such that the control module 20 is positioned at the bottom of the lighting apparatus. The connector 30 may provide the physical attachment point for connecting the control module 20 to the lighting apparatus 10 and the electrical attachment point for connecting the control module 20 to the lamp electronics 110 and the power supply 101 such that the control module 20 may control the operation of the light source 100. The control module may be releasably connected to the connector such that different control modules may be attached to the connector 30. The connector 30 may comprise electrical contacts 31 that releasaably connect to contacts 33 of the control module 20 to power the control module, transmit and receive signals between the control module and the lamp electronics and that may be in the path of power from the power source to the light source such that the control module may function as an on/off switch. In one embodiment the control module 20 is located in the electrical path to the light source 100 between the electrical power supply 101 and the lamp electronics 110. The control module 20 may control the power delivered to the lamp electronics 110 to turn the light source 100 on and/or off and to otherwise control the operation of the light source 100 such as by dimming the light source, changing the color of the emitted light, or the like. To turn the light source 100 on and/or off the control module 20 may act as a simple switch that opens or closes the electrical path to the light source. To otherwise control the light source the control module 20 may control the current and/or voltage delivered to the light source where the change in the current or voltage is used by the lamp electronics 110 to control operation of the LEDs 127. Where the control module acts as a simple on/off switch the control module may control operation of the light source without communication with the light source. In other embodiments, the control module may send control information to the light source that where the control information is used by the light source to control the operation of the LEDs. The control information may be contained in an electrical control signal encoded with information that is received by the lamp electronics of the light source. In other embodiments the control information may be a change in the current and/or voltage delivered to the light source rather than an encoded signal. In some embodiments where the control module 20 operates as an on/off switch the control information may be considered the absence or presence of power delivered to the lamp electronics.

One embodiment of the base 18 is shown comprising a bottom member 42 that is configured to attach to the bottom of the lens 14 to partially define enclosure 12. The bottom member 42 supports the connector 30 and the control module 20 at a bottom outside surface of the enclosure and may support the light source 100 in the enclosure 12. A plurality of spaced support members or fingers 44 extend from the bottom member 42 and connect the bottom member 42 to a mounting member 46 such as a bracket or other mating engagement member. The mounting member 46 is configured to be attached to a support structure that supports the lighting apparatus 10 in the desired location. In one embodiment the mounting member 46 is configured to be mounted to the top of a pole 21. The pole 21 and the mounting member 46 comprise mating engagement structures that connect the pole 21 to the base 18. In one embodiment the engagement structures comprise a female receptacle 48 on one of the mounting member 46 and the pole 21 that receives a mating male protrusion 50 on the other one of the mounting member or pole. In the illustrated embodiment the end of the pole 21 forms the male engagement member that is inserted into the receptacle 48 formed on the mounting member 46. The bottom member 42, support members 44 and the mounting member 46 maybe formed of a single unitary member or may be formed of a plurality of members joined together to define a rigid support for the enclosure 12.

The mounting member 46 may comprise a variety of engagement members. For example the engagement member may define a plate 52 having apertures 54 formed therein for receiving fasteners such as screws or bolts that engage the support structure where the plate 52 may fit onto a second mating plate formed on a pole, wall or other support structure that receives the fasteners. In some embodiments, the mounting member 46 may be configured to be attached to a junction box or similar support structure. Other mounting members may also be used to mount the lighting apparatus to a support structure.

Figure 6:
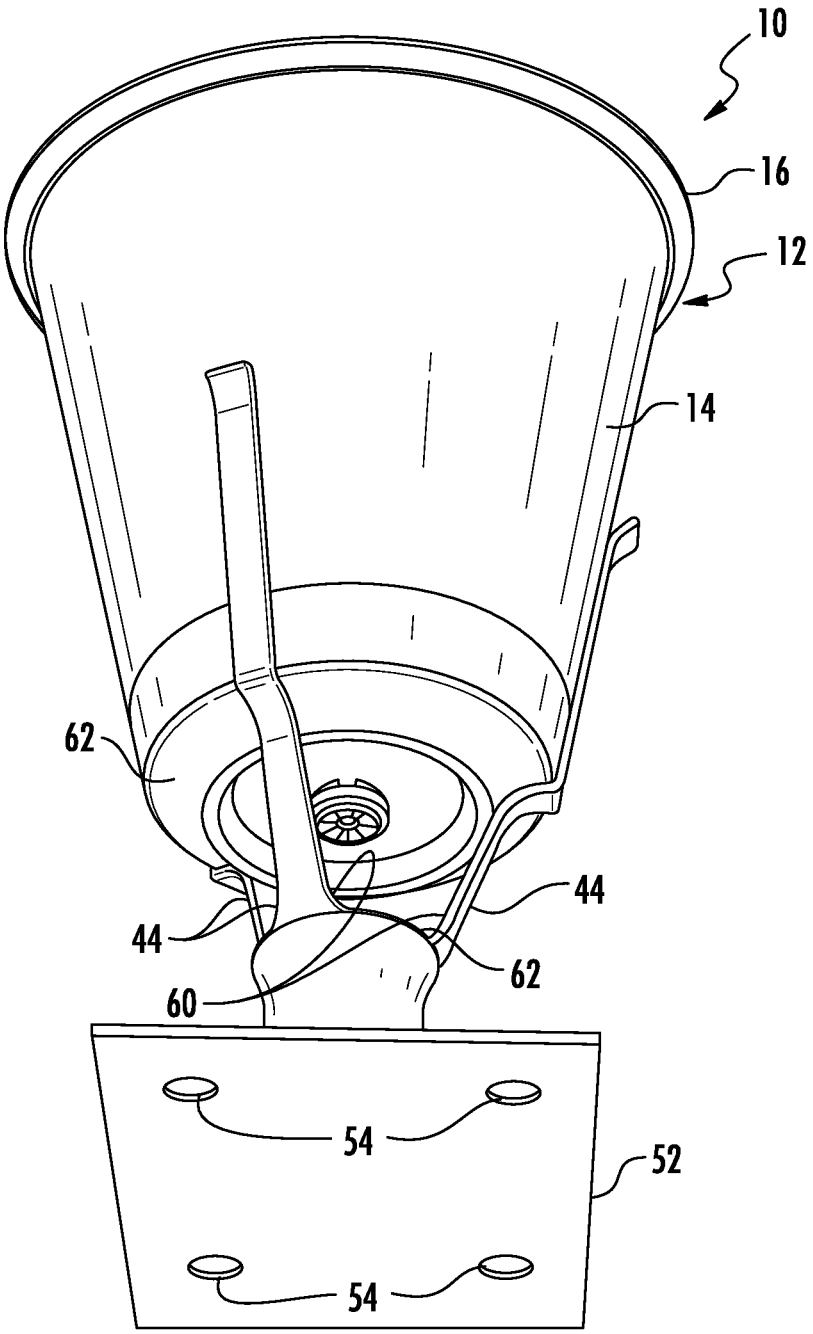
FIG. 6 is a perspective view of another embodiment of the lighting apparatus of the invention.
Figure 9:
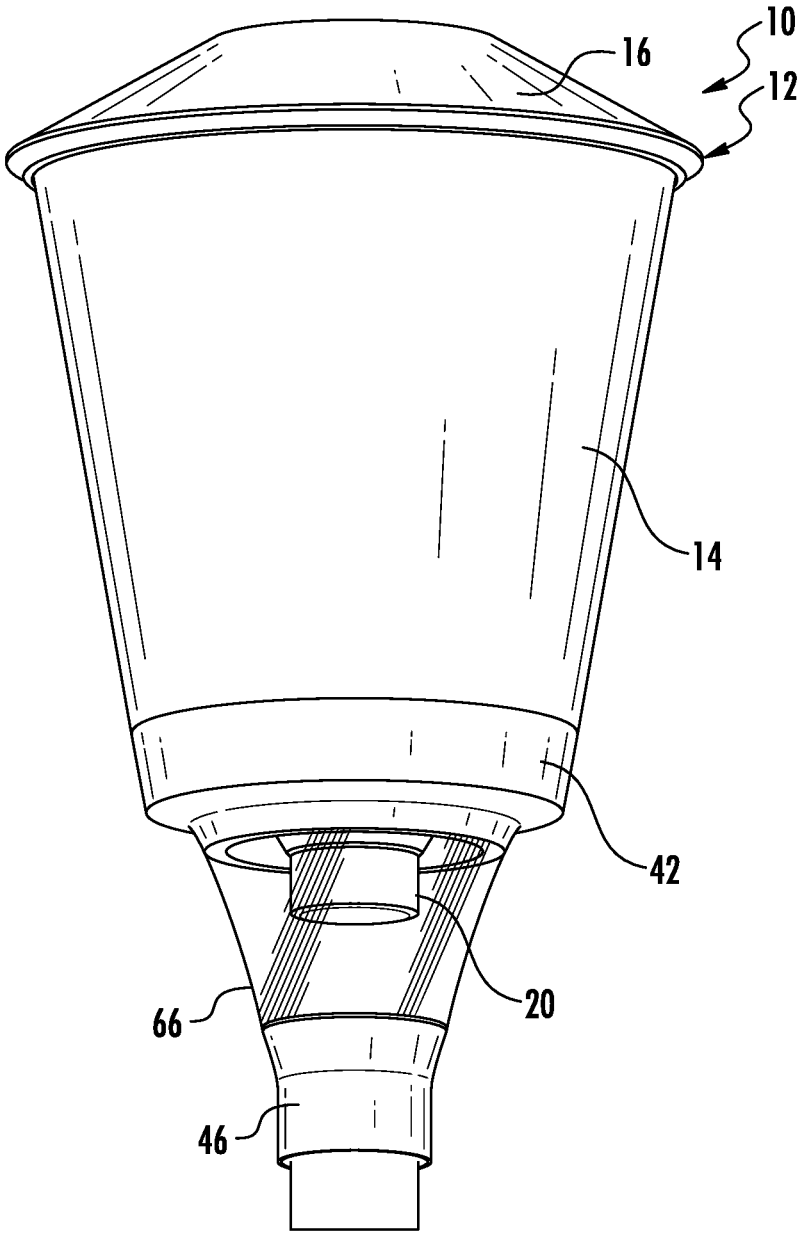
FIG. 9 is a perspective view of another embodiment of the lighting apparatus of the invention.

The support members 44 are spaced from one another to create apertures 60 in the base 18 that surround the sensor 20*a*, 20*b* such that the emitters/detectors of the sensor 20*a*, 20*b* are not obstructed and may detect external stimuli through the apertures 60. In one embodiment the support members 44 are made relatively narrow such that the apertures 60 make up the major portion of the base 18 between the bottom member 42 and the mounting member 46. In this manner the sensor 20*a*, 20*b* may be oriented in virtually any angular position relative to the lighting apparatus and still have access to the external environment. While three support members 44 are shown that define three apertures 60 a greater or fewer number of support members and apertures may be used. For example a single support member may be provided such that a single aperture constitutes the entire space between the bottom member 42 and the mounting member 46 except for the single support member. The apertures 60 may be covered by a transparent or clear window 62 (as shown in FIG. 6) such that the sensor 20*a*, 20*b* is in an enclosed space in the base 18. In other embodiments the support member may comprise a transparent member 66 that functions as the physical support between the bottom member 42 and the mounting member 46 and provides optical access between the sensor 20*a*, 20*b* and the external environment as shown in FIG. 9.

Because the connector 30 and control module 20 are positioned at the bottom of the enclosure 12 water may run down the lighting apparatus 10 towards the connector 30 and control module 20. To prevent water from interfering with the operation of the control module 20, a drip guard 40 may be provided on the bottom of the bottom member 42 of the lighting apparatus 10. The drip guard 40 may comprise an annular flange that extends from the bottom of the bottom member 42 and surrounds the control module 20 and connector 30. Water accumulating on the lighting apparatus 10 will run to the bottom of the drip guard 40 where it will gather and drip from the lighting apparatus 10 without draining or running to the control module 20 and connector 30. The drip guard 40 is dimensioned and configured such that the sensors 20*a*, 20*b* of control module 20 extend beyond the end of the drip guard 40 such that the drip guard does not interfere with the ability of the detectors to detect a stimulus.

Depending on the type of control module 20 used it may be desirable in some applications to control the direction of the control module 20 relative to the lighting apparatus 10. In some embodiments, a sensor may be used that is directional such that it may desirable to orient the sensor in a particular direction. For example, it may be desirable to orient the emitters and/or detectors of sensor 20*a*, 20*b* towards a pathway, street, doorway or other location to detect the presence of a person, vehicle, or other object located in that area. For daylight sensors it may be desirable to point the sensor in a desired direction, such as due north. It also may be desirable to position the sensor such that it is unobstructed by the lighting apparatus or mounting structure. In one embodiment, the connector 30 is rotatable relative to the enclosure such that the control module 20 may be oriented to the desired angular position after the lighting apparatus 10 is mounted to a support structure. In one embodiment, the connector 30 comprises a first portion 30*a* that is connected to the control module 20 and that rotates relative to a second portion 30*b* that is connected to the lighting apparatus 10 such that a control module 20 mounted on the connector 30 may be rotated with the first portion 30*a* relative to the lighting apparatus. In other embodiments the entire connector 30 may be made rotatable relative to the enclosure. In this manner after the lighting apparatus 10 is mounted on a support structure the control module 20 may be rotated to direct the sensor in a desired direction. In one embodiment the connector 30 and the control module 20 are rotated about a substantially vertical axis A-A although the connector 30 and the control module 20 may be rotated about other than a substantially vertical axis.

Figure 7:
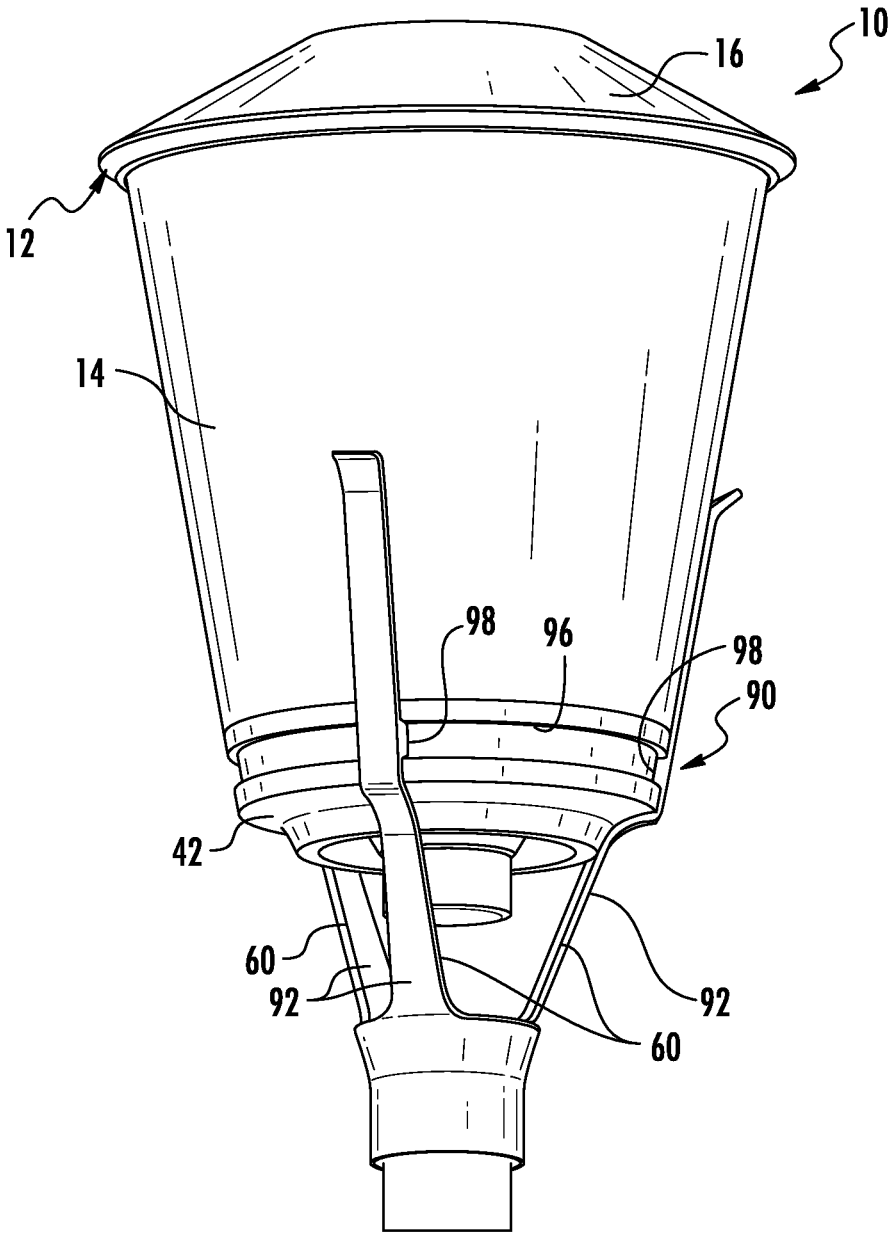
FIG. 7 is a perspective view of another embodiment of the lighting apparatus of the invention.
Figure 8:
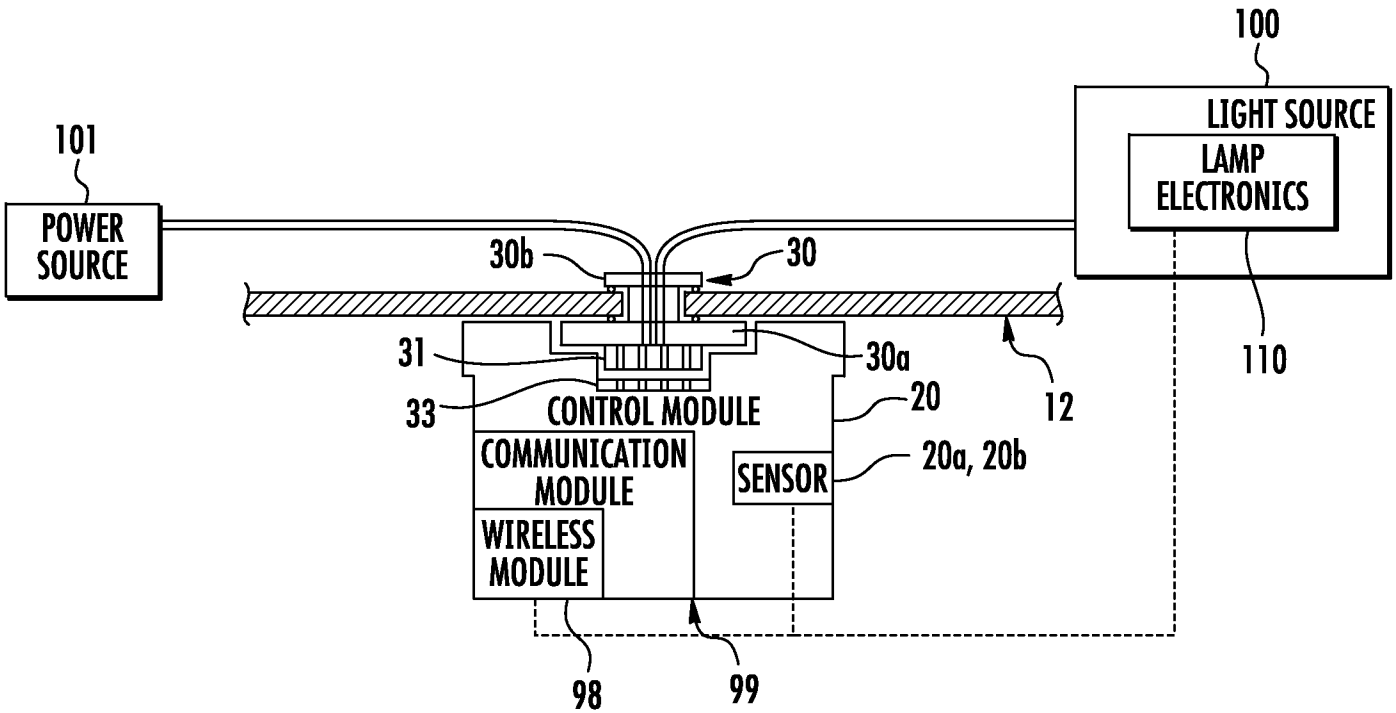
FIG. 8 is a schematic view of the lighting apparatus of the invention.

In other embodiments the connector 30 and the control module 20 may be fixed relative to the enclosure 12 and the base 18 may be configured to allow the enclosure 12 and the control module 20 to be oriented in a desired angular orientation after the enclosure is mounted to the base 18. One embodiment of a base 90 is shown in FIG. 7 comprising a bottom member 42 and separate spaced support members or fingers 92 that engage the enclosure 12. The support members 92 extend from the mounting member 46 and are spaced to receive the enclosure 12 therebetween. The support members 92 may be made of a resilient material such as plastic, aluminum or the like and the support members may be configured such that the support members are resiliently flexible. In this manner the space between the support members 92 may be made slightly smaller than the diameter of the enclosure 12 such that the support members 92 are deformed slightly outwardly when the enclosure is located between the support members. The resilient material of the support members creates a clamping force on the enclosure that holds the enclosure in the base. In some embodiments, the support members 92 grip the lighting apparatus with enough force that the lighting apparatus is held in the base 90 but is allowed to rotate relative to the base such that the angular position of the enclosure 12 and, therefore, the control module 20 may be adjusted to orient the control module 20 in the desired direction. In one embodiment, one of the enclosure 12 or support members 92 may comprise a track 96 such as a recess or protrusion that extends about the periphery thereof and the other one of the lighting apparatus and the support members may comprise a slide structure 98 that mechanically engages the track 96 but that allows the enclosure 12 and control module 20 to be angularly rotated relative to the base 18.

In some embodiments the control module 20 may comprise a communication module 99 for receiving and/or transmitting a control signal between the lighting apparatus and remote controller and/or between lighting apparatuses provided with communication modules 99. The communication module 99 may comprise a wireless module 98 comprising a wireless transceiver, receiver and/or transmitter. The wireless module 98 may convert a received radio wave to an electronic signal that may be delivered to the lamp electronics 110 for controlling operation of the light source. The wireless module may also transmit wireless signals to control other lighting apparatuses, for diagnostic purposes or the like. The communication module 99 may be mounted in control module 20 and may be in communication with the lamp electronics. The communication module 99 and sensors 20*a*, 20*b* may be provided in the same control module 20 or the communication module 99 and sensors 20*a*, 20*b* may be mounted in separate control modules that are mounted to separate connectors 30 mounted on the bottom of the enclosure such that the communication module 99 and sensors 20*a*, 20*b* may be provided independently. In some embodiments the communication module may be hard wired to the remote controller rather than using a wireless module.

In various embodiments described herein various smart technologies may be incorporated in the lamps as described in, but not limited to, the following applications "Solid State Lighting Switches and Fixtures Providing Selectively Linked Dimming and Color Control and Methods of Operating," application Ser. No. 13/295,609, filed Nov. 14, 2011, which is incorporated by reference herein in its entirety; "Master/Slave Arrangement for Lighting Fixture Modules," application Ser. No. 13/782,096, filed Mar. 1, 2013, which is incorporated by reference herein in its entirety; "Lighting Fixture for Automated Grouping," application Ser. No. 13/782,022, filed Mar. 1, 2013, which is incorporated by reference herein in its entirety; "Multi-Agent Intelligent Lighting System," application Ser. No. 13/782,040, filed Mar. 1, 2013, which is incorporated by reference herein in its entirety; "Routing Table Improvements for Wireless Lighting Networks," application Ser. No. 13/782,053, filed Mar. 1, 2013, which is incorporated by reference herein in its entirety; "Commissioning Device for Multi-Node Sensor and Control Networks," application Ser. No. 13/782,068, filed Mar. 1, 2013, which is incorporated by reference herein in its entirety; "Wireless Network Initialization for Lighting Systems," application Ser. No. 13/782,078, filed Mar. 1, 2013, which is incorporated by reference herein in its entirety; "Commissioning for a Lighting Network," application Ser. No. 13/782,131, filed Mar. 1, 2013, which is incorporated by reference herein in its entirety; "Ambient Light Monitoring in a Lighting Fixture," application Ser. No. 13/838,398, filed Mar. 15, 2013, which is incorporated by reference herein in its entirety; "System, Devices and Methods for Controlling One or More Lights," application Ser. No. 14/052,336, filed Oct. 10, 2013, which is incorporated by reference herein in its entirety; and "Enhanced Network Lighting," Application Ser. No. 61/932,058, filed Jan. 27, 2014, which is incorporated by reference herein in its entirety.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lighting apparatus comprising:

an at least partially optically transmissive enclosure, the enclosure comprising a base positioned at the bottom of the enclosure;

a LED light source located in the enclosure and operable to emit light when energized through an electrical path;

a connector rotatably mounted to the base configured to receive a control module comprising a sensor for controlling the LED light source such that the connector and the control module are rotatable together relative to the enclosure, the connector being electrically coupled to the control module such that the control module controls the LED light source through the connector; a mounting member secured to the enclosure and an aperture between the mounting member and the base allowing detection of a stimulus.

2. The lighting apparatus of claim 1 where the base comprises a bottom member, the connector located between the mounting member and the bottom member.

3. The lighting apparatus of claim 2 further comprising a transparent window between the mounting member and the bottom member.

4. The lighting apparatus of claim 1 wherein the enclosure is rotatable relative to the mounting member.

5. The lighting apparatus of claim 1 wherein the sensor detects the presence or absence of ambient light.

6. The lighting apparatus of claim 1 wherein the sensor detects the presence or absence of an object.

7. The lighting apparatus of claim 1 further comprising a drip guard surrounding the connector.

8. The lighting apparatus of claim 7 wherein the drip guard comprises an annular flange that surrounds the connector.

9. The lighting apparatus of claim 1 wherein the sensor turns the LED light source off upon detection of the stimulus.

10. The lighting apparatus of claim 1 wherein the sensor changes the color of the emitted light upon detection of the stimulus.

11. The lighting apparatus of claim 1 wherein the control module comprises a communication module for receiving external control signals.

12. The lighting apparatus of claim 11 wherein the communication module comprises a wireless receiver for receiving external wireless signals.

13. The lighting apparatus of claim 1 wherein the control module provides control information to the LED light source.

14. A lighting apparatus comprising:

an at least partially optically transmissive enclosure;

a mounting member secured to the enclosure configured to mount the enclosure to a support structure;

a LED light source located in the enclosure and operable to emit light when energized through an electrical path;

an electrical connector secured to the bottom of the enclosure and positioned between the enclosure and the mounting member, the electrical connector being configured to releasably receive a control module for providing control information to the LED light source through the electrical connector;

a drip guard positioned on the bottom of the enclosure comprising an annular flange that surrounds the connector.

15. The lighting apparatus of claim 14 wherein the control module comprises a sensor for detecting external stimuli.

16. The lighting apparatus of claim 14 wherein the sensor turns the LED light source off and on upon detection of the stimuli.

17. The lighting apparatus of claim 4 wherein the enclosure comprises a bottom member, the connector being secured to the bottom member.

18. A lighting apparatus comprising:

an at least partially optically transmissive enclosure, the enclosure comprising a base positioned at the bottom of the enclosure;

a LED light source located in the enclosure and operable to emit light when energized through an electrical path;

a connector secured to the base configured to receive a control module for controlling the LED light source, the connector being electrically coupled to the control module such that the control module controls the LED light source through the connector, a mounting member, a transparent window between the mounting member and the enclosure allowing detection of a stimulus by the control module, the transparent window supporting the enclosure on the mounting member.

* * * * *